US005816880A

United States Patent [19]

Forti et al.

[11] Patent Number: 5,816,880

[45] Date of Patent: Oct. 6, 1998

[54] GYROSCOPIC FLYING DEVICE

[76] Inventors: William M. Forti; William B. Forti, both of 311 W. 6th St., Claremont, Calif. 91711

[21] Appl. No.: 573,241

[22] Filed: Dec. 15, 1995

Related U.S. Application Data

[63] Continuation-in-part of Ser. No. 139,513, Oct. 19, 1993, abandoned, which is a continuation-in-part of Ser. No. 827,091, Jan. 21, 1992, abandoned.

[51] Int. Cl.[6] ..... A63H 27/08

[52] U.S. Cl. ..... 446/61; 446/34

[58] Field of Search ..... 446/34, 61, 71, 446/68

[56] References Cited

U.S. PATENT DOCUMENTS

| | | |
|---|---|---|
| 2,683,603 | 7/1954 | Gackenbach . |
| 3,264,776 | 8/1966 | Morrow . |
| 3,359,678 | 12/1967 | Headrick . |
| 4,151,674 | 5/1979 | Klahn et al. . |
| 4,246,721 | 1/1981 | Bowers . |
| 4,390,148 | 6/1983 | Cudmore . |
| 4,456,265 | 6/1984 | Adler . |
| 4,790,788 | 12/1988 | Hill . |
| 4,850,923 | 7/1989 | Etheridge . |
| 5,067,922 | 11/1991 | McMahon . |
| 5,152,709 | 10/1992 | Johnson, III et al. . |

OTHER PUBLICATIONS

"Flying Rings Around You" Popular Mechanics, p. 71, Sep. 1979.

"Things to Fling" The Christian Science Monitor, Oct. 8, 1996.

*Primary Examiner*—Kien T. Nguyen

*Attorney, Agent, or Firm*—Robert D. Fish, Esq.; Crockett & Fish

[57] ABSTRACT

A free spinning annular cylinder-like hollow body, having a leading and trailing end which are open at the ends. The leading end contains a balanced, uniformly and heavily weighted dense rim for generating gyroscopic forces. When the device is propelled forward with a spinning motion about an axis in substantially the direction of flight, the body is gyroscopically stabilized, in reference to direction, attitude and orientation. The weighted rim also shifts the body's center of gravity toward the center of pressure, near the leading edge, which enables creation of lift.

15 Claims, 4 Drawing Sheets

GYROSCOPIC FLYING DEVICE

This is a continuation-in-part of U.S. application Ser. No. 08/139,513 filed Oct. 19, 1993 now abandoned which is a continuation-in-part of application Ser. No. 07/827,091 filed Jan. 21, 1992 now abandoned.

BACKGROUND OF THE INVENTION

1. Field of the Invention

This invention relates to gyroscopic flying mechanisms having an annular hollow body of cylindrical-like shape which can be manually or mechanically propelled.

2. Description of the Prior Art

The prior art discloses various tubular devices to be thrown through the air with a spinning motion in the direction of an axis through the device.

An early example was disclosed in U.S. Pat. No. 3,264,776 to Morrow, in which a straight, hollow tube with unbalanced weighting toward the leading end is propelled with a rotational motion about its longitudinal axis. A slight taper extended from the trailing end to the leading end on both the interior and external surfaces of the tube. The tube was provided with a forward annular weighted area, such that its center of gravity was located within the leading one-half to one-third of the tube. Best stability was noted with length to diameter rations (L/D) of around 1:1 to 1:2. Moving the center of gravity toward the leading part of the tube, along with tapered surfaces and proper diameter ratios, was believed to produce aerodynamic characteristics which enhance flight in a direction along its longitudinal axis.

Kahn, et al., in U.S. Pat. No. 4,151,674, claims improved aerodynamic performance by incorporating a ledge along the forward edge of the cylindrical body. The rearwardly directed ledge is claimed to reduce drag and move the center of gravity to the forward quarter of the total length. Best performance was reported with the center of gravity placed at about 25% of the distance from the leading edge.

Bowers, in U.S. Pat. No. 4,246,721, teaches the use of an annular recess on the outer surface of the hollow body adjacent the leading edge, together with an annular ridge formed on the adjacent inner wall. In addition, a weighted annular ring is adjustably positioned within the cylinder so as to change the station location of the forward center of gravity. Selection of the center of gravity is said to change the aerodynamic characteristics so as to produce several curvilinear flight paths.

Hill, in U.S. Pat. No. 4,790,788 states that the above-cited devices have not had much commercial impact because aerodynamic characteristics are easily lost. He notes that said devices have erratic, unpredictable and inconsistent flight characteristics. He allegedly achieves consistent flight by improving aerodynamic characteristics in a dimensionally constrained design by placing a relatively thick peripheral ring at the laden edge of a short tube body. The ring leading edge is chamfered while the trailing edge fairs smoothly into the tube doby thickness. It is stated that the L/D ratio must be held between 0.8 and 0.74, and the ratio of leading end to trailing end weight must be about 2.2 to 1 to place the center of gravity at substantially the intersection of forward and rearward body sections.

Etheridge, in U.S. Pat. No. 4,850,923, also notes limitations and shortcomings of prior art devices. He claims to improve flight through employment of a number of aerodynamic specific point designs. The outer surface inclines radially outwardly and rearwardly at a 16-degree angle in order to increase lift. The ratio of leading area weight to trailing area weight is substantially between 2.2:1 to 2.5:1 with an L/D design of about 0.86.

It may be noted that all of the above devices are designed based upon aerodynamic considerations, i.e., center of gravity positioning, tubular shapes, leading and trailing edge angles, side tapering, surface characteristics, length to diameter ratios, etc. While all of the devices spin and have some degree of front weighting, none providing very satisfactory flight results and none appear to have been commercially successful. Thus, a need still exists for a device of this general type that provides greatly enhanced flight characteristics in terms of duration and distance, spin momentum and smoothness, as well as predictability and consistency.

SUMMARY OF THE INVENTION

The present invention is directed to a free-spinning annular cylinder-like hollow body flying apparatus, open at both ends, having a leading and a trailing end and having a side wall with an inner and outer surface. The body contains a weighted, dense and balanced annular rim along its leading edge, which acts as a gyroscope when spinning. The rim must be sufficiently dense and weighted to produce substantial gyroscopic effects when the body is propelled through the air with a spinning motion. Significant and adequate gyroscopic effects cannot be achieved without proper weighting, density and balance. The free-spinning gyroscopic rim allows the body to maintain its reference direction, attitude and orientation while in flight. The weighted rim also shifts the body's center of gravity forward toward the leading edge, which enables the creation of lift. It is the balanced interaction between substantial gyroscopic forces and aerodynamic lift forces which creates superb flight performance.

The annular hollow body can be of various sizes utilizing different materials such as light plastics, metal or composite materials. However, the leading edge rim must be sufficiently dense and weighted in order to create the needed angular momentum to maintain substantial gyroscopic stability. Also, the body must incorporate a specific range of dimensional trim parameters in order to create proper lift. The device's efficient gyroscopic characteristics and accompanying trim factors make for exceptional flight performance and distances.

Gyroscopic principles are well-known. In the case of this device, a dense and weighted gyroscopic rim is located toward the leading edge of the body. When propelled forward at launch with a spinning motion, the dense and weighted spinning rim allows the body to maintain its projected direction and attitudinal orientation. In other words, the rim's angular momentum prevents it from nosing down as a response to the force of gravity. Angular momentum H is defined as $H=MR^2W$, where M is the mass, R the radius of the rim about the spin axis, and W is the spin velocity.

This orientational stability allows the top and bottom cylindrical segments of the spinning body to act as dual wings. Therefore, when the center of gravity and the center of pressure are properly placed in conjunction with the correct forward weighting parameters of the gyroscopic rim, lift is created in much the same way as the fixed airfoils of a bi-winged airplane. As long as the angular momentum of the device, as described in the above formula, is adequate to offset disturbing torques, such as gravity, the cylinder will hold its orientation and fly in the direction of launch. However, as the device loses its angular momentum, gravity will prevail and the rim will tend to nose down about its horizontal axis. Further, as the nose begins to turn downwardly, the resulting forces of gyroscopic precession cause the device to precess from right to left (if its spinning direction is clockwise), and the flight path will follow the direction of precession. A gyroscope's precession rate is expressed as P=T/H, where P is the rate of precession, T is the applied torque, and H is the angular momentum.

In the case of a cylindrical body, with a thin, uniform side wall, it has been determined from experimental results that a number of design parameters are critical in achieving proper performance. First, the weight of the rim must be between 75% and 90% of the device's total weight. This is crucial for efficient gyroscopic performance. Secondly, gyroscopic performance is affected by mass, density, and weight. The density of the ring to the total weight of the device must be less than about 1 to 8. Thirdly, unwanted aerodynamic turbulence is created by the aft portion of the rim which forms a step, notch, chamfer or taper on the body wall. Preferably, no differential in thickness should exist whereby the outer and inner diameter of the rim is the same as the body. In no event should the thickness of the aft portion of the ring be greater than about 0.4 percent of the body's total exterior surface area. Fourthly, the rim and body must be trimmed for proper flight performance. The rim should constitute an area along the leading edge amounting from about 18% to 32% of the device's axial length. Also, the length to diameter of the device should be between 1 to 1 and 1 to 2.

It will be noted that the simple design of this invention operates well without aerodynamic modifications. This is because stability of this design depends more upon gyroscopic effects than aerodynamic variations required by prior art. However, nothing in the fundamental design taught herein precludes variations which could alter flying characteristics, including leading edge angles, the addition of ribs, grooves, notches or fins to the body, etc. Also, the trailing edge of the body can have different geometric shapes such as curves, waves as well as asymmetric shapes. It is understood that variations will be detrimental to flight performance if they materially interfere with the maximum gyroscopic performance of the rim.

It is an object of the present invention to obtain superb flight performance of a spinning hollow body utilizing balanced interaction between substantial gyroscopic forces and aerodynamic lift forces.

Yet another object of this invention is to provide a rotating flight vehicle which can be easily propelled, either manually or mechanically.

Yet another object of the invention is to provide a rotating flight vehicle with a reduced sensitivity to aerodynamic characteristics of the body shape.

Still another object of the invention is to provide a flight vehicle which can be inexpensively manufactured.

Still another object of the invention is to provide a flight vehicle which can be inexpensively sold in a disassembled form and easily assembled by the end user.

Still another object of the invention is to provide a flight vehicle that is relatively safe to use.

The above and other objects, features and advantages of the present invention will become more apparent when making reference to the following detailed description and to the accompanying sheets of drawings in which preferred structural embodiments incorporating the principles of this invention are shown.

DETAILED DESCRIPTION OF THE PREFERRED EMBODIMENT

Figure 1:
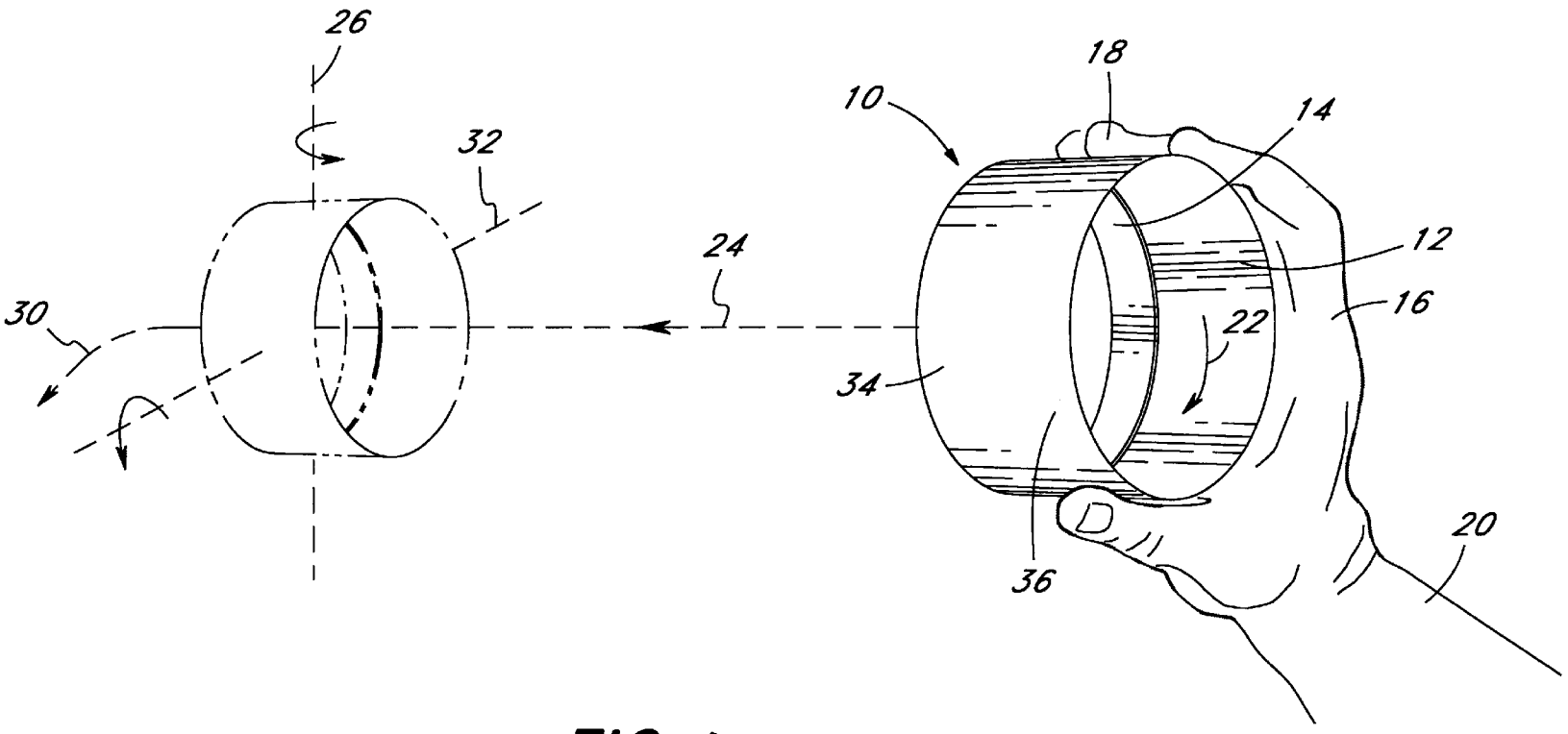
FIG. 1 is a rear perspective view illustrating the operation of a gyroscopic flying device in accordance with the present invention as an aerial sports toy which is manually propelled.

With reference to FIG. 1, there is shown the general operation of a gyroscopic flying cylinder body 10 in accordance with the present invention when thrown by a hand 16 as an aerial sports toy. The body 10 includes a hollow cylindrical body 12 with a leading end 34 and a trailing end 36. A dense and weighted rim 14 is shown attached to the interior of the cylinder 12 at the leading end 34. The body 10 is shown being manually held by a hand 16 just prior to launch. When the body 10 is thrown by the hand 16, gripping fingers 18 work in cooperation with a wrist 20 to impart axial spin to the device in the direction illustrated by arrow 22. At the same time, the hand 16 provides an initial forward velocity along spin axis 24. It is anticipated that manual usage will include games of catch or competition events in which throwers aim for maximum flight times, distance or accuracy.

The forward rim 14 is preferably made of spring steel that allows for resiliency when gripped by hand 16. The rim may be formed into a ring by bending the spring steel in a circular fashion and fastening it by a weld adhesive, or by mechanical means. The rim 14 may be heavily coated with any number of plastic coatings to avoid exposure of sharp edges and provide of safety. The cylinder 12 of the body 10 can be constructed by adhering materials such as plastic, rubber, cloth or thin metal around the outside, the inside, or both the inside and outside of the rim 14.

The body 10 is designed for manufacturability. The rim 14 can be fashioned from either a steel strap, wire coil or spring by using traditional rolling, welding, coiling or spin-making equipment. The material which makes up the cylinder 12 can simply be wrapped around the rim 14 by hand or by utilizing machines. Adhesion of the material to the rim 14 can be achieved by utilizing either glue or transfer tapes. The use of tape has the advantage of enabling the product to be sold in a disassembled kit form, if so desired. A rim with a section of transfer tape wrapped around the rim may be sold in ring form. A protective layer on the tape may then be removed, and a strip of stiff but rollable material is wrapped around the rim, and held by the adhesive. Injection molding and extrusion manufacturing processes also can be readily utilized.

Figure 4:
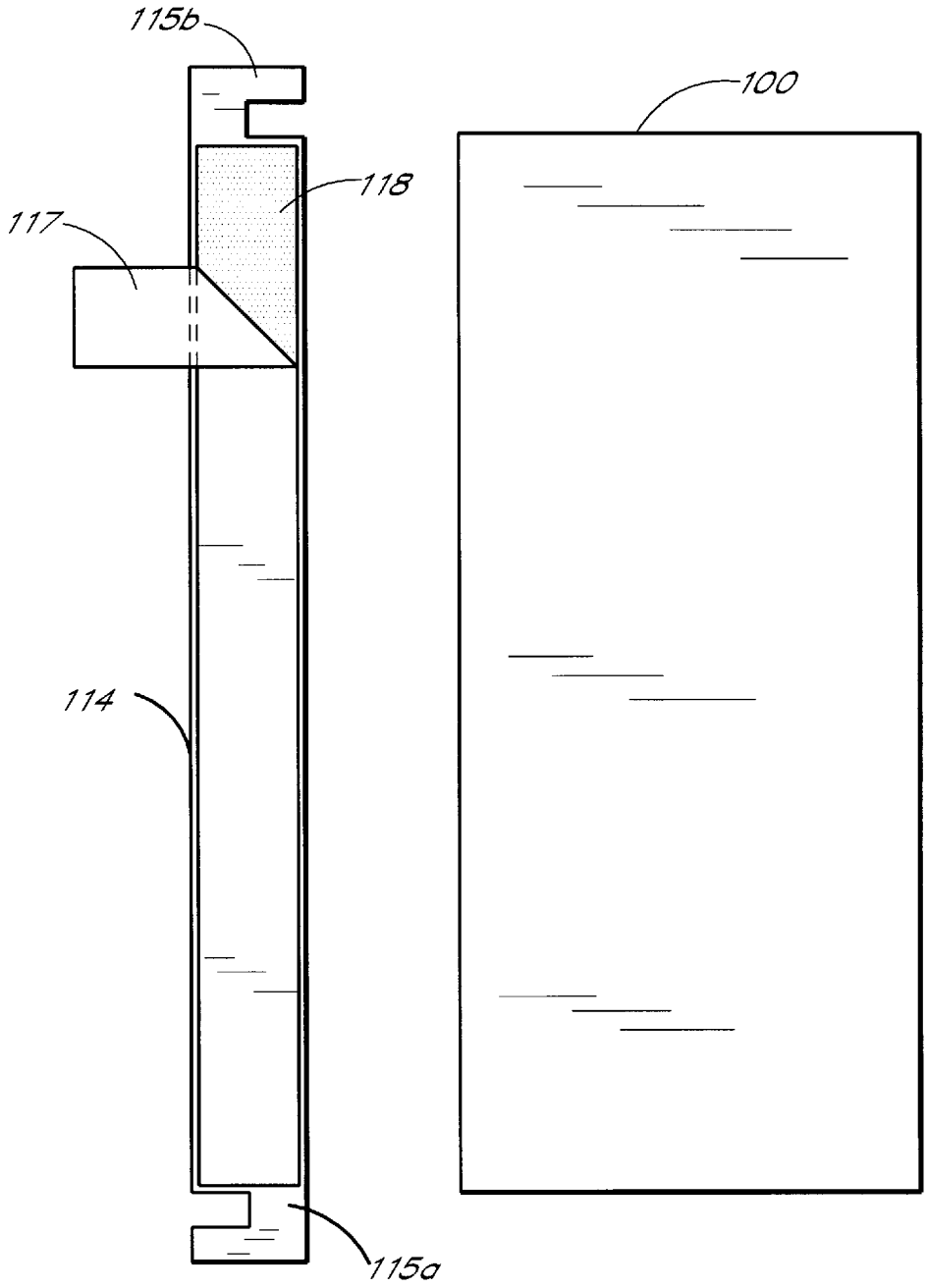
FIG. 4 is a plan view of one form of the toy before it is assembled.
Figure 5:
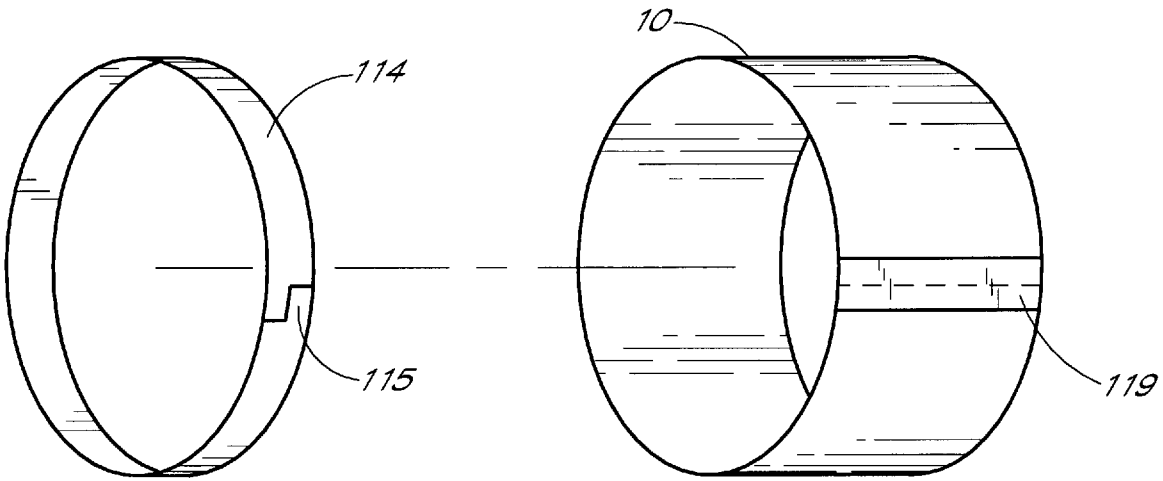
FIG. 5 is a perspective view illustrating the manner that the rim and body of FIG. 5 are assembled.

Referring to FIG. 4, the product can alternatively be sold with the rim 114 lying flat incorporating a buckling mechanism at opposite ends 115*a* and 115*b* and transfer tape 117 affixed to one side. The body 100 also would be sold flat. The product could be assembled by the end-user as follows: a protective layer 118 of the transfer tape 117 is removed from the flat rim 114 exposing the adhesive. The flat rim is taped to the leading edge of the body 100. The flat rim and body are then formed into a cylinder as seen in FIG. 5, whereby the rim is fastened into a circle by coupling the ends 115 of the rim. The rim is positioned on the inside of the cylinder and the spring tension of the rim naturally holds it and the body 10 in a circular fashion. A seam is formed with tape 119 along the cylinder's length when the body is fastened together.

In a preferred embodiment of the present invention, the cylinder 12 has a diameter of about 3.75 inches, a length of about 2.125 inches, and a wall thickness of about 0.010 inches, while the front rim portion 14 has a wall thickness of about 0.040 inches. The aft portion of the ring that abuts the cylinder wall forms a negligible differential of about 0.030 inches. As noted above it is desirable that this aft portion be thin so as to minimize turbulence introduced by that discontinuity. Preferably the thickness is less than about 0.4% of the external surface area of the body 10. The length of the rim 14 is 0.5 inches, which accounts for 23.5% of the body's 10 total length. A range of about 18% to 32% is satisfactory. The cylinder 12 and the rim 14 combination weighs approximately 26 grams. These dimensions provide optimal characteristics for a game of catch because of the following results: a straight and stable flight can be achieved for both long and short distances; the cylinder fits comfortably within the grip of an average sized man; the diameter of the cylinder is large enough to reduce the possibility of someone being inadvertently struck in the eye; and the cylinder's lightweight construction prevents serious harm if someone is accidentally struck.

It will be recognized that body 10 can be launched by various known mechanical or powered mechanisms means which can aim and impart the initial velocity and spin conditions. Such means may be carried aboard a spinning device or may be externally separate. Included in these means are springs, catapults and other leverage mechanisms, explosive or burning propellant system, as well as normal powered devices running on electricity or various fuel systems.

Referring again to FIG. 1, it has been found that when properly thrown, the device will initially follow a substantially linear flight path from the initial direction 24. Rapid spinning imparts gyroscopic effects which tend to stabilize the flight path against the gravitational forces acting to rotate the heavy gyroscopic rim 14 downward about a horizontal axis 32. Toward the end of the flight, when the spinning and forward velocity diminish, the device will process from right to left about a vertical axis 26. The flight then will veer to the left along path 30. The end of flight is characterized by the rim nosing down accompanied by gyroscopic coring motions.

Figure 2:
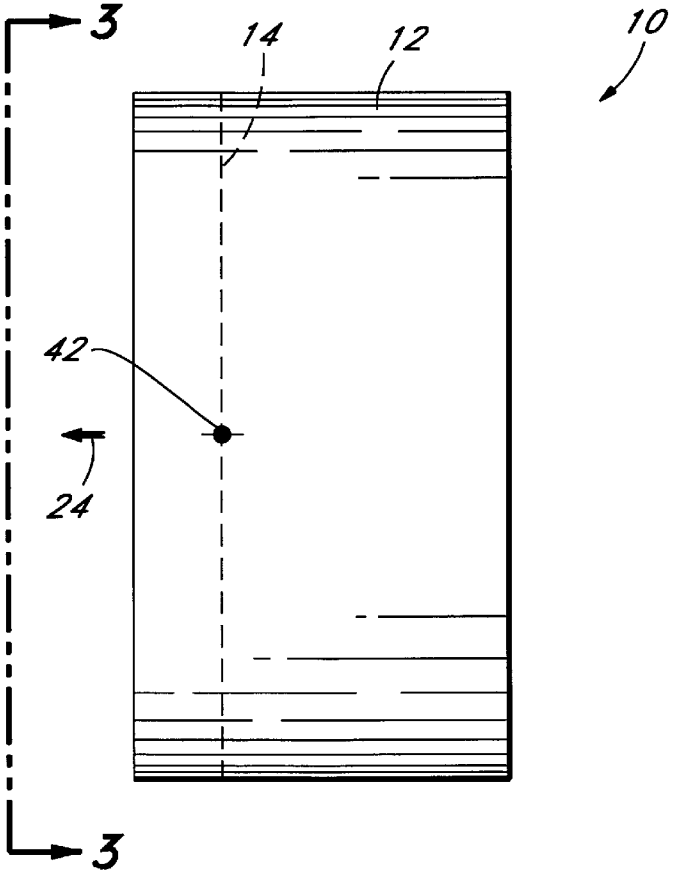
FIG. 2 is a side elevation view of the device of FIG. 1 depicting the x axis and showing the forward leading edge.

FIG. 2 shows a side view of the body 10 with the weighted, dense and balanced rim 14 oriented with its x axis along the direction of launch arrow 24. The rim portion 14 is comprised of a thin annular metal band attached to the leading edge of the internal wall of the cylinder 12. The body's center of gravity is shown at point 42.

Figure 3:
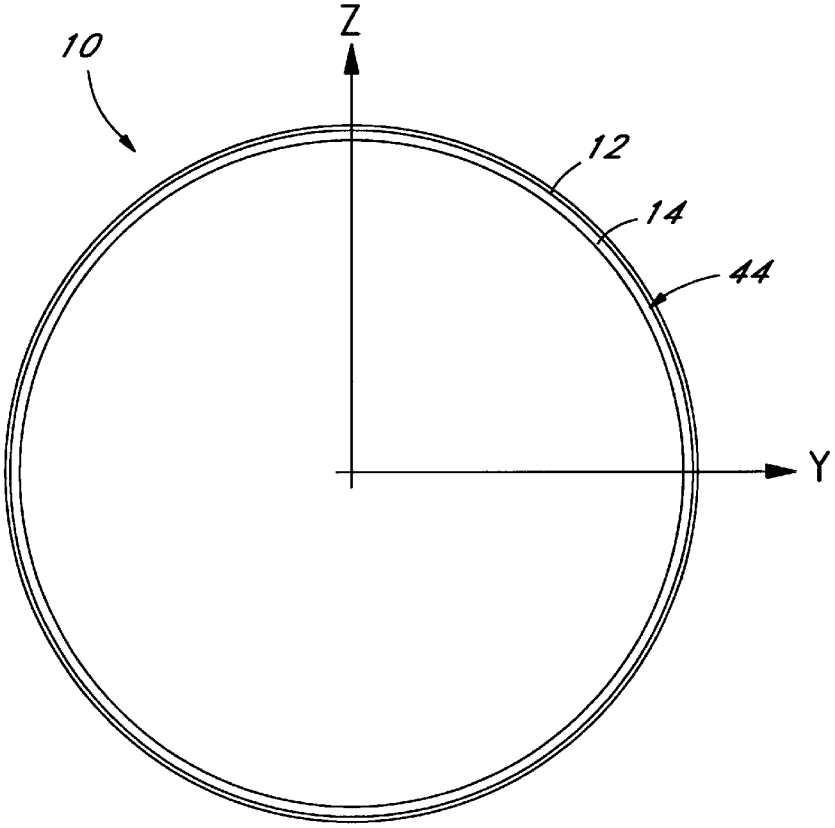
FIG. 3 is an end view of the device of FIG. 1 as seen from the leading edge.

FIG. 3 shows the front view of the body 10 corresponding to the line 3—3 of FIG. 2, with y and z axes exposed. Leading edge 44 is comprised of the rim 14 and the cylinder 12 has a thickness of less than about 0.1 inch.

The performance of the body 10 is heavily dependent upon the weight of the rim 14. The weight of the rim 14 is preferably between 75% and 90% of the total weight of the body 10. Experiments have been performed to obtain these results. Comparative performance tests have been made which show the importance of appropriate up-front weighting to obtain significant gyroscopic effects and enhanced flight performance. Plastic models were used having body lengths of 2 inches and diameters of 3.75 inches. Various weighted metal rims with densities of 7.85 g/cm3 have been added to the forward region along the leading edge. Table 1 below presents "normal thrown" averages of approximate flight ranges of devices with different rim weight percentages obtained under wind still conditions and an observation appraisal of flight characteristics.

TABLE 1

| % of Rim Weight to the Total Device | Average Normal Throw (Yards) | Flight Characteristics |
|---|---|---|
| 51% | 15 Yds | Very wobbly spin, poor lift, does not soar, no precession. |
| 64% | 20 Yds | Wobbly spin, poor lift, does not soar, no precession. |
| 73% | 50 Yds | Rough spin, exhibits lift and soars somewhat, some precession. |
| 81% | 65 Yds | Smooth spin, exhibits good lift and soars well, precession. |
| 86% | 65 Yds | Very smooth spin, exhibits good lift and soars well, much precession. |
| 90% | 40 Yds | Noses down, much precession. |

To summarize, the table shows that performance unexpectedly and dramatically increases, as weighting increases to the range of 75% to 90% and then dramatically falls off above 90%.

Not only is rim weight important to performance, but density of the rim in proportion to overall body weight is also a key factor. To demonstrate this point, comparative performance tests have been made, which show the importance of rim density to obtain significant gyroscopic spinning and enhanced flight performance. As with the previously described tests, plastic models were used, each having a body length of 2 inches and a diameter of 3.75 inches. In this case, the weights of the rims were held constant at 17 grams, but the materials used had different densities. The overall weight was kept the same as indicated above, 26 grams. While this is a desirable weight for long distance throws, different weights can be employed so long as the other parameters are met, such as the rim weight and location, and rim density. The table below presents "normal throw" averages of approximate flight ranges of devices with different rim densities obtained under wind-still conditions and observation appraisals of flight characteristics.

TABLE 2

| Material | Density to Total Weight | Average Normal Throw (Yards) | Flight Characteristics |
|---|---|---|---|
| Polycarbonate | 1 to 21.6 | 25 Yds | Wobby spin, poor lift, unstable flight. |
| Aluminum | 1 to 9.6 | 35 Yds | Rough spin, some lift, unstable flight. |
| Tin | 1 to 4.5 | 56 Yds | Smoother spin, exhibits lift, more stable. |
| Steel | 1 to 3.3 | 65 Yds | Smooth spin, lifts very well, very stable flight. |
| Lead | 1 to 2.3 | 74 Yds | Smooth spin, very strong lift, very stable flight. |

It should be noted that this gyroscopic data confirms the expectation of improved distances and flight characteristics with increased forward rim weight distributions and density to weight make-up. As can be seen, rims of polycarbonate, which has a density of 1.2 grams per $cm^3$, or aluminum, having a density of 2.7 grams per $cm^3$, gave unsatisfactory performance. By contrast, tin, 5.75 $g/cm^3$; steel, 7.84 $gm/cm^3$; and lead 11.34 $gm/cm^3$ gave good results. Further experimentation has shown that a density to total weight ratio of less than about 1 to 8 is satisfactory.

Weight distributions of the present invention are determined without regard to aerodynamic modifications concerning the shape of the cylinder's wall. In contrast, prior art weight distributions are cited in conjunction with a variety of specific aerodynamic shape modifications. Nevertheless, weight distributions of previous designs are well below the criteria of having the rim account of 75% of the total weight, as indicated above. Furthermore, there is nothing in the prior art which reveals the importance of having high density material for making the rim. As indicated earlier, proper body trim factors must accompany the gyroscopic rim parameters to obtain the exceptional flight performance of the present invention. Therefore, previous designs cannot achieve sufficient gyroscopic stabilization to reach the greater ranges or smoother flight characteristics exhibited by the present invention. The superior design of the present invention over the prior art is dramatically evidenced in drastic performance improvement. Maximum ranges for "hard throws" of the present invention by a typical man can exceed 150 yards. By comparison, tests show that "hard throws" of Hills' actual device (which Hill claimed a considerable improvement overall previous patents) have rough flights and do not exceed 35 yards. Also, hard throws of McMahon's device show rough flights and do not exceed 30 yards.

Although the present invention has been described in considerable detail with reference to certain preferred cylindrical aerial toy versions thereof, other versions and applications are possible. The present invention can be utilized in the defense industry as a bullet, projectile, mortar, target practice device, self-propelled aircraft, etc. Also, it may be used in the medium of water as a torpedo or submarine. Furthermore, various hollow body shapes and known aerodynamic modifications may also be spun and flown. Therefore, the spirit and scope of the appended claims should not necessarily be limited to the description of the preferred version sand applications contained herein.

What is claimed is:

1. A free spinning gyroscopic flying device comprising a cylinder having an outer diameter and an overall length, leading and following open ends, an axial center of gravity positioned between the leading and following ends wherein the center of gravity is at least 70% of the distance from the following end to the leading end, and a weighted region having a wall thickness no greater than about 0.04 inches.

2. The device of claim 1 wherein the diameter is at least 50% greater than the length.

3. The device of claim 1 further comprising a non-weighted region having a wall thickness no greater than about 0.01 inches.

4. The device of claim 3 wherein the non-weighted region is substantially smooth.

5. The device of claim 3 wherein the non-weighted region is substantially non-perforated.

6. The device of claim 3 further comprising the non-weighted region has a substantially constant outside diameter.

7. The device of claim 1 wherein the diameter is at least 50% greater than the length, and further comprising a non-weighted region having a wall thickness no greater than about 0.01 inches.

8. The device of claim 1 wherein the diameter is at least 50% greater than the length, and further comprising a substantially smooth non-weighted region having a wall thickness no greater than about 0.01 inches.

9. The device of claim 1 wherein the diameter is at least 50% greater than the length, and further comprising a substantially non-perforated non-weighted region having a wall thickness no greater than about 0.01 inches.

10. The device of claim 1 wherein the diameter is at least 50% greater than the length, and further comprising a non-weighted region having a substantially constant outside diameter.

11. The device of claim 1 further comprising a non-weighted region having a wall thickness no greater than about 0.01 inches.

12. The device of claim 1 further comprising a substantially smooth non-weighted region having a wall thickness no greater than about 0.01 inches.

13. The device of claim 1 further comprising a substantially non-perforated non-weighted region having a wall thickness no greater than about 0.01 inches.

14. The device of claim 1 further comprising a non-weighted region having a substantially constant outside diameter and a wall thickness no greater than about 0.01 inches.

15. The device of claim 1 wherein the diameter is at least 50% greater than the length, and further comprising a substantially smooth, substantially non-perforate non-weighted region having a substantially constant outside diameter and a wall thickness no greater than about 0.01 inches.

* * * * *